US007559791B1

(12) United States Patent
Kao et al.

(10) Patent No.: US 7,559,791 B1
(45) Date of Patent: Jul. 14, 2009

(54) PCB CONNECTOR WITH IDENTIFIABLE CHARACTERS

(75) Inventors: Yung-Shun Kao, Taipei (TW); Ya-Han Chang, Taipei (TW)

(73) Assignee: Giga-Byte Technology Co., Ltd., Taipei (TW)

( * ) Notice: Subject to any disclaimer, the term of this patent is extended or adjusted under 35 U.S.C. 154(b) by 0 days.

(21) Appl. No.: 12/289,412

(22) Filed: Oct. 28, 2008

(30) Foreign Application Priority Data

Apr. 23, 2008 (TW) ..... 97206973 U

(51) Int. Cl.
*H01R 3/00* (2006.01)

(52) U.S. Cl. ..... 439/491; 439/78

(58) Field of Classification Search ..... 439/488, 439/491, 78, 79, 82, 83
See application file for complete search history.

(56) References Cited

U.S. PATENT DOCUMENTS 5,470,253 A * 11/1995 Siems et al. ..... 439/491
5,681,183 A * 10/1997 Dzmura ..... 439/502
5,790,896 A * 8/1998 Nguyen ..... 710/72
5,795,180 A * 8/1998 Siebens ..... 439/489
7,326,075 B1 * 2/2008 Armstrong et al. ..... 439/354

* cited by examiner

*Primary Examiner*—Khiem Nguyen
(74) *Attorney, Agent, or Firm*—Rosenberg, Klein & Lee

(57) ABSTRACT

A connector for connection to a printed circuit board includes a body, a plurality of contact pins on both side of the body, and an identification layer joined to one side of the body. In particular, the identification layer defines a plurality of holes for insertion of the contact pins. Further, the identification includes at least one character thereon for identifying function or use of the connector and a background in a color different from that of the character.

11 Claims, 4 Drawing Sheets

PCB CONNECTOR WITH IDENTIFIABLE CHARACTERS

BACKGROUND OF INVENTION

1. Field of Invention

This invention relates to a connector and more particularly to a PCB connector with identifiable characters for misinsertion prevention.

2. Related Prior Art

Various forms of PCB connectors or connector sockets are known in the art, for connecting an external connector (or an external device) to a printed circuit board of a computer. Such PCB connectors are typically formed of colors, notches or unique combination of contact pins to ensure fool-proof identification. In this way, misinsertion of a wrong type of device onto the PCB connector may be prevented if a user follows the guidance of the color, notch or contact pins. However, there are still a number of things about installing or building up a computer which causes confusion and uncertainty to those who are new to this activity. For example, in a case where connectors are so similar to one another, except the number of the contact pins, a user may get confused quite easily due to inattention even if a Computer's User Manual for information is at hand. Without distinct identification, all types of connectors may still be troublesome to be distinguished from one another and be inserted by a suitable external connector plug or device, (particularly if the person performing the installation hasn't had much practice). It may take long time merely to correctly assemble a computer and ensure its correct functionality and long life.

SUMMARY OF INVENTION

Broadly stated, the present invention is directed to a PCB connector or connector socket for connection to a printed circuit board. The PCB connector includes a body, a plurality of contact pins on both side of the body, and an identification layer joined to one side of the body. In particular, the identification layer defines a plurality of holes for insertion of the contact pins. The identification layer includes at least one character thereon for identifying function or use of the connector and a background in a color different from that of the character. Due to the distinct character(s) of the identification layer, the PCB connector is easily recognized, and therefore the assembly time of a computer is greatly saved and misinsertion is prevented.

Preferably, a distinguish mark is provided to surround a specific one of the contact pins only and has a color different from that of the background. In this way, the hole or position for the specific contact pin is apparently indicated.

The advantages of the present invention will be understood more readily after a consideration of the drawings and the Detailed Description.

BRIEF DESCRIPTION OF DRAWINGS

The invention is illustrated by the accompanying drawings in which corresponding parts are identified by the same numerals and in which.

DETAILED DESCRIPTION OF EMBODIMENTS

Figure 1:
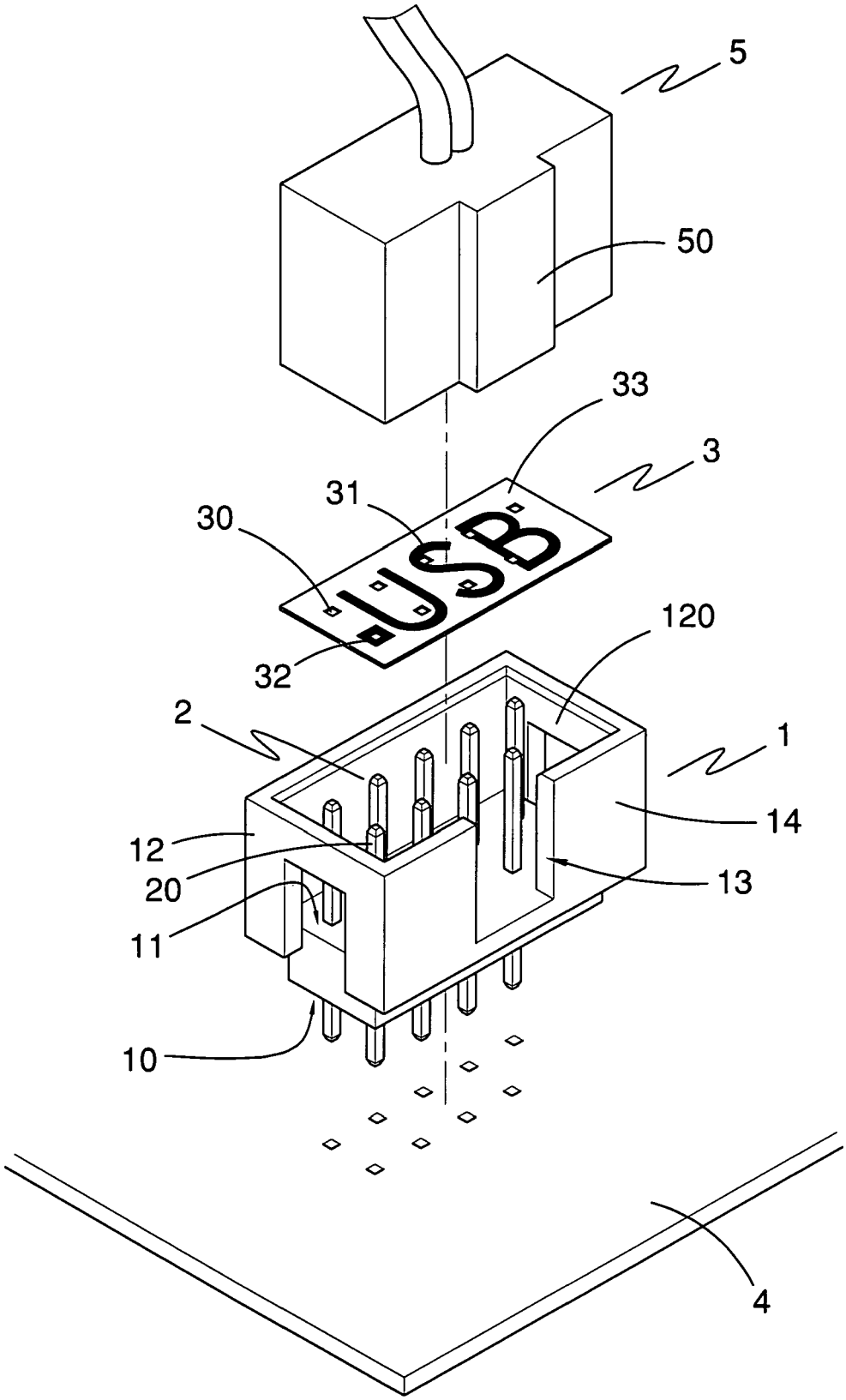
FIG. 1 is an exploded view of a connector in accordance with an embodiment of the invention, showing that the connector is configured to connect an external connector and a printed circuit board.
Figure 2:
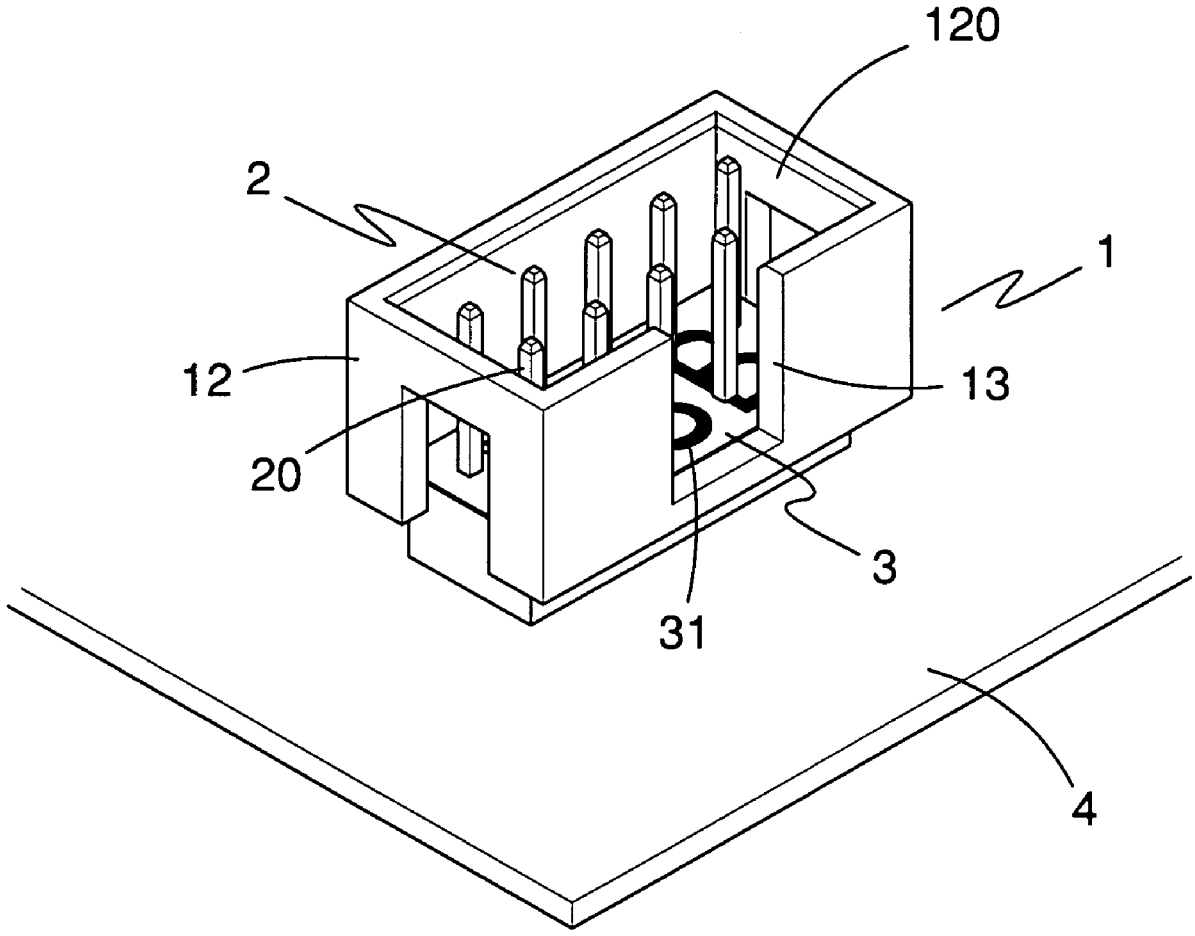
FIG. 2 is an assembled perspective view of the connector of FIG. 1, in which the connector is mounted on the printed circuit board.
Figure 3:
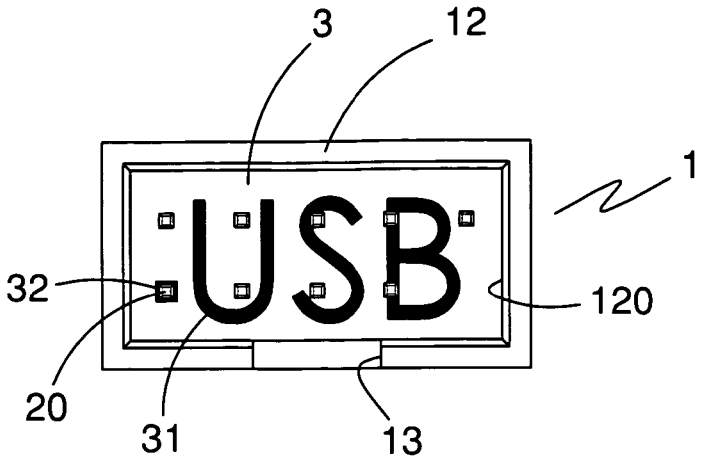
FIG. 3 is a top view of the connector of FIG. 1, in which a set of identifiable characters "USB" is shown.

Referring now to FIGS. 1-3, a PCB connector or a connector socket according to the present invention is mounted on a printed circuit board 4 and includes a body 1, a plurality of contact pins 2 and an identification layer 3. Referring to FIGS. 1 and 2, the body 1 has a first surface 10 and a second surface 11 opposite the first surface 10. The first surface 10 faces the printed circuit board 4. The body 1 is formed with a peripheral frame 12 extending upward around the second surface 11. The peripheral frame 12 and the second surface 11 together define a receptacle 120 for receiving an external connector 5 or an external device. A fool-proof notch 13 is defined in a side wall 14 of the peripheral frame 12 and is dimensioned to conform to a protrusion 50 of the external connector 5 to ensure that a wrong type of device is not inserted. In such a fashion, the PCB connector is protected from misalignment of the external connector 5 or misinsertion of a wrong type of external connector. In this embodiment, the printed circuit board 4 is a motherboard of a computer host.

Those contact pins 2 are disposed on the body 1 and extend outside the first and second surfaces 10, 11.

The identification layer 3 is joined to the second surface 11 of the body 1. A plurality of holes 30 are defined in the identification layer 3 for insertion of the contact pins 2. In particular, the identification layer 3 includes at least one identifiable character 31, a distinguish mark 32 and a background 33. The identifiable character 31 in a color different from that of the background 33 is provided for identifying function or use of the PCB connector. The distinguish mark 32, also in a color different from that of the background 33 is disposed adjacent to a specific one 20 of the contact pins 2 only. In this embodiment, the identification layer 3 is an adhesive label, such a sticker or a nameplate. The adhesive label having adhesive at one side is to be stuck onto the second surface 11 of the body 1. Referring to FIG. 3, the identification layer 3 includes the set of characters 31, namely "USB" in order to indicate that the PCB connector is applied for the external connector 5 which is in compliance with "USB" industry standard. The distinguish mark 32 surrounding the specific contact pin 20 is to clearly indicate where the specific contact pin 20 locates.

Figure 4:
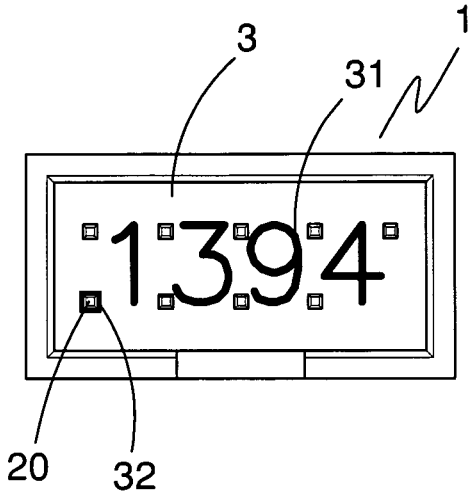
FIG. 4 is a view similar to FIG. 3 according to another embodiment of the present invention, in which anther set of identifiable characters "1394" is shown.
Figure 5:
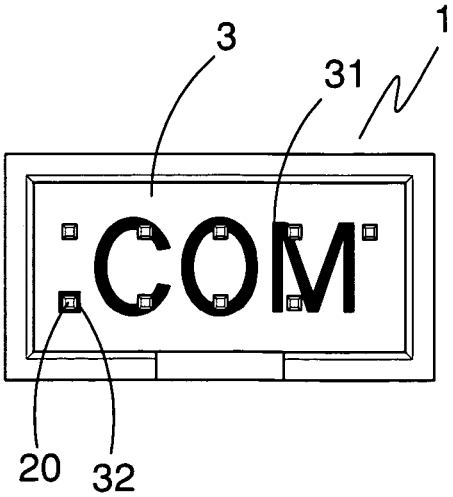
FIG. 5 is a view similar to FIG. 3 according to yet another embodiment of the present invention, in which anther set of identifiable characters "COM" is shown.

FIGS. 4 and 5 illustrate two other sets of characters 31 according to other embodiments. One is "1394" and the other is "COM". The set of characters "1394" of FIG. 4 indicates that the PCB connector is applied for an external connector which is in compliance with the IEEE 1394 standard. Likewise, the set of characters "COM" of FIG. 5 indicates that the PCB connector is applied for an external connector which is in compliance with the COM interface standard. It should be noted that other sets of identifiable characters 31 may be arranged for identification.

Figure 6:
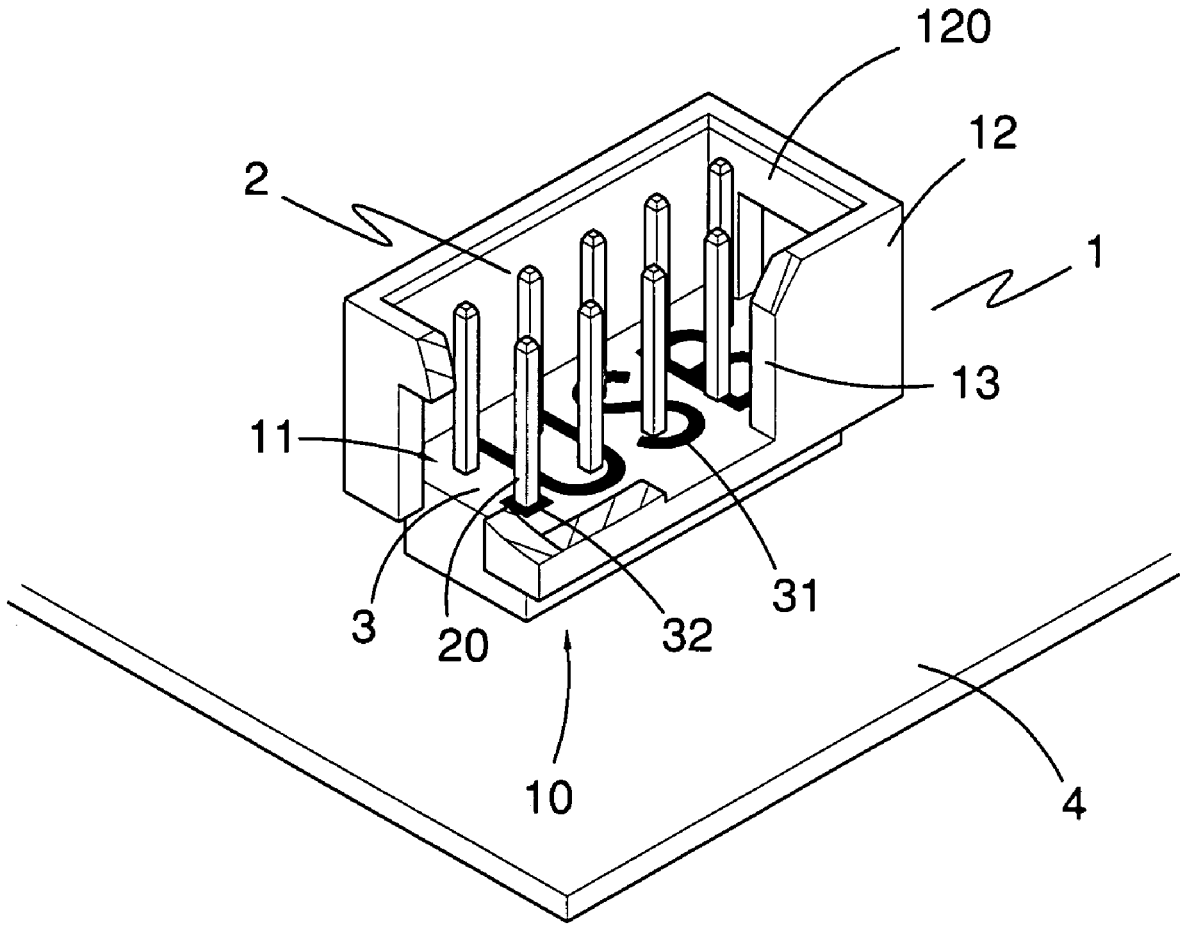
FIG. 6 is a perspective view, partially broken away to show details of construction, of a connector in accordance with another embodiment of the invention, showing that a set of identifiable characters USB is directed printed on a base of the connector.

With reference to FIG. 6, a PCB connector in accordance with another embodiment of the invention is illustrated. Substantially all of the features discussed in the above-mentioned embodiment apply to this embodiment. The major difference is that the identification layer 3 is directly printed on the second surface 11 of the body 1.

It will be appreciated that although particular embodiments of the invention have been shown and described, modifications may be made. It is intended in the claims to cover such modifications which come within the spirit and scope of the invention.

The invention claimed is:

1. A connector for connection to a printed circuit board, comprising:

a body having a first surface facing said printed circuit board and a second surface opposite said first surface;

a plurality of contact pins disposed on said body and extending outside said first and second surfaces; and an identification layer joined to said second surface of said body and defining a plurality of holes for insertion of said contact pins, wherein said identification layer includes at least one character thereon for identifying function or use of said connector and a background in a color different from that of said character.

2. The connector of claim 1, wherein said body is formed with a peripheral frame extending around said second surface; and said peripheral frame and said second surface co-define a receptacle.

3. The connector of claim 2, wherein said peripheral frame has a side wall defining a notch therein to ensure that a wrong type of device is not inserted.

4. The connector of claim 1, wherein said identification layer is an adhesive label.

5. The connector of claim 2, wherein said identification layer is an adhesive label.

6. The connector of claim 1, wherein said identification layer is directly printed on said second surface of said body.

7. The connector of claim 2, wherein said identification layer is directly printed on said second surface of said body.

8. The connector of claim 1, wherein said identification layer further includes a distinguish mark thereon adjacent to one of said contact pins.

9. The connector of claim 2, wherein said identification layer further includes a distinguish mark thereon adjacent to one of said contact pins.

10. The connector of claim 8, wherein said distinguish mark has a color different from that of said background and surrounds a specific one of said contact pins only.

11. The connector of claim 9, wherein said distinguish mark has a color different from that of said background and surrounds a specific one of said contact pins only.

* * * * *